US007038634B2

(12) United States Patent
Bisig

(10) Patent No.: US 7,038,634 B2
(45) Date of Patent: May 2, 2006

(54) OPTIMIZATION OF A LOOP ANTENNA GEOMETRY EMBEDDED IN A WRISTBAND PORTION OF A WATCH

(75) Inventor: Martin Bisig, Zuchwil (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 18 days.

(21) Appl. No.: 10/882,233

(22) Filed: Jul. 2, 2004

(65) Prior Publication Data

US 2006/0001583 A1 Jan. 5, 2006

(51) Int. Cl.
*H01Q 7/00* (2006.01)
*H01Q 1/12* (2006.01)

(52) U.S. Cl. ..... 343/866; 343/718

(58) Field of Classification Search ..... 343/276, 343/282, 718, 748, 866
See application file for complete search history.

(56) References Cited

U.S. PATENT DOCUMENTS

| | | | | |
|---|---|---|---|---|
| 4,884,252 | A | 11/1989 | Teodoridis et al. | |
| 5,132,697 | A | 7/1992 | Tan | |
| 5,134,724 | A | 7/1992 | Gehring et al. | |
| 5,136,303 | A | 8/1992 | Cho et al. | |
| 5,179,733 | A | 1/1993 | Matsui | |
| 5,243,356 | A | 9/1993 | Hama | |
| 5,280,296 | A * | 1/1994 | Tan et al. | 343/718 |
| 5,465,098 | A | 11/1995 | Fujisawa et al. | |
| 5,526,006 | A | 6/1996 | Akahane et al. | |
| 5,532,705 | A | 7/1996 | Hama | |
| 5,589,840 | A | 12/1996 | Fujisawa | |
| 5,736,196 | A | 4/1998 | Decker et al. | |
| 5,742,256 | A * | 4/1998 | Wakabayashi | 343/718 |
| 5,768,217 | A * | 6/1998 | Sonoda et al. | 368/10 |
| 5,986,566 | A | 11/1999 | Yamamori | |
| 6,329,903 | B1 | 12/2001 | Yamamori | |
| 6,765,846 | B1 * | 7/2004 | Saitou et al. | 368/10 |

FOREIGN PATENT DOCUMENTS

| | | |
|---|---|---|
| CH | 684 868 A5 | 1/1991 |
| EP | 334 297 A2 | 3/1989 |
| EP | 631 341 A1 | 6/1994 |
| EP | 1 315 234 | 5/2003 |
| GB | 2 201 266 A | 8/1988 |
| JP | 58-94204 | 6/1983 |
| JP | 3-85905 | 4/1991 |
| JP | 3-181208 | 8/1991 |
| JP | 3-198532 | 8/1991 |
| JP | 3-265304 | 11/1991 |

(Continued)

OTHER PUBLICATIONS

Japanese Unexamined Utility Model Publication No. 56-085409; Dec. 4, 1954.

(Continued)

*Primary Examiner*—Tan Ho
*Assistant Examiner*—Minh Dieu A
(74) *Attorney, Agent, or Firm*—Sughrue Mion, PLLC

(57) ABSTRACT

The invention relates to a wireless instrument (1) including a wristband (2) having two band portions (2*a*, 2*b*) connected to opposite edges of a casing (3), each band portion having upper and lower surfaces (21,22). At least one single loop antenna (4*a*) is embedded in one band portion and extends between the corresponding upper and lower surfaces. This single loop antenna is connected via feeding lines (7) through one edge of the casing to an antenna receiver (5). The loop antenna and the feeding lines define a radiating element, wherein the feeding lines are arranged so as to be a negligible part of this antenna radiating element.

9 Claims, 4 Drawing Sheets

FOREIGN PATENT DOCUMENTS

JP 7-283632 10/1995

OTHER PUBLICATIONS

Japanese Unexamined Utility Model Publication No. 56-087807, Dec. 12, 1954.

Japanese Unexamined Utility Model Publication No. 57-132283, Feb. 12, 1956.

Japanese Unexamined Utility Model Publication No. 59-64591, Apr. 19, 1984.

* cited by examiner

OPTIMIZATION OF A LOOP ANTENNA GEOMETRY EMBEDDED IN A WRISTBAND PORTION OF A WATCH

FIELD OF THE INVENTION

The invention relates to a wrist-carried wireless instrument for receiving signal in the radio frequency range, and more particularly, to a wristwatch receiver having magnetic loop antennas embedded in the wristband. In the following specification, loop antenna has to be understood as one single loop conductor lying substantially in the same plane, the frequency of operation of which is normally such as to give a substantially uniform current along the conductor.

BACKGROUND OF THE INVENTION

In recent years, such wireless instruments for receiving radio frequency signals with an antenna system embedded in the wristband have become common. Many prior art solutions disclose an antenna device having a circumferentially variable size, embedded in a wristband, for use with a radio that is worn on the arm of a person. By doing this, the antenna can be made long enough to receive frequency signals beyond the VHF band (30–300 MHz). As shown on FIG. 3, loop antenna 101 can be formed in a unitary fashion inside wristband 102, which is connected to casing 103 of wrist-carried wireless instrument 100 to form a continuous loop via a center fastening structure 104, for example a clasp, of the wristband when the band is fastened.

However, in such arrangements the loop connection at center fastening structure 104 significantly influences reception. Consequently it is difficult to design a mechanism that provides favourable operation, as this part is prone to break down. In addition, wristband 102 typically contains a wristband adjusting structure to adjust the length of the wristband to the thickness of the wearer's arm. This adjustment causes the antenna's loop length to vary from wearer to wearer, which causes variations in the receivable frequency band from one wearer to another.

A solution consisting in providing wireless instrument 100 with an additional apparatus for compensating changes in antenna gain and resonance frequency resulting from changes in the antenna's loop length, is complex and bulky, which is not desirable in such wireless instruments.

According to the U.S. Pat. No. 5,986,566, it is disclosed a solution, shown on FIG. 4, to prevent connection failure and/or breakdown due to attachment or detachment of a loop antenna, of the afore cited type, and to provide a wrist-carried wireless instrument whose receivable frequency band is not affected by the thickness of the wearer's arm.

Wrist-carried wireless instrument 110 includes a casing 113 and a center fastening-type wristband 112. Wristband 112 has upper 121 and lower 122 surfaces and a fastening structure 114 at its center and consists of a pair of wristband parts 112*a* and 112*b*, each of which is attached to an end of casing 113. A receiving antenna 111 is mounted inside in at least one part 112*a* of the wristband to receive signals, antenna 111 being connected via terminals to a known reception circuit inside casing 113. According to this document, loop antenna 111 extends between upper 121 and lower 122 surfaces of wristband 112 and does not go through center fastening structure 114. It is to be noted that reception would be possible without having wristband 112 attached and forming a loop, as it does when worn.

FIG. 5 shows a sectional view of a portion of wrist-carried wireless instrument 110 according to the prior art shown on FIG. 4. The same elements between FIGS. 4 and 5 are identified with the same numerical references. U-shaped antenna 111 is embedded in one part 112*a* of the wristband and is connected through casing 113 to an antenna receiver, not explicitly represented, located on a reception circuit substrate 114, via feeding lines for conveying received signals from the antenna to the antenna receiver. In this example the feeding lines are formed by terminals 115 soldered at the ends of U-shaped antenna 111 to provide connection with contact pins 116 who press on terminal springs 117 molded on substrate 114.

In such small antennas, the radiation resistance is very small compared to ohmic and dielectric or permeability antenna losses caused by electric conductors, dielectric or magnetic materials used in the wireless instrument. Therefore, the antenna gain is predominantly given by antenna losses. Because loss of the antenna compared to radiation resistance is very high, the loop antenna geometry has to be carefully chosen with a maximum radiating surface and minimum antenna losses.

Nevertheless within the scope of the present invention, measures done on the antenna structure according to the U.S. Pat. No. 5,986,566 have shown up non-optimum antenna efficiency due to non-negligible losses. As a matter of fact, the antenna radiating element of the antenna structure, as shown on FIG. 5, includes not only U-shaped loop 111 inside the wristband part but also feeding lines 115, 116 and 117 connecting the loop antenna to the antenna receiver inside casing 113. Furthermore, when wireless instrument 110 is worn on the user's arm, the U-shaped loop and the feeding lines are nearly right-angled as shown on FIG. 6. Resulting radiating surface RS1+RS2 of the antenna radiating element (U-shaped loop and feeding lines), referenced B as a whole, is in a plane $P_h$ parallel to hypotenuse h of the right triangle formed by the U-shaped loop and the feeding lines and corresponds to the sum of both radiating surface projections RS1 and RS2 related to the contribution of each part of the radiating element in the aforementioned plane $P_h$. Thus, although resulting radiating surface RS1+RS2 increases slightly, in the meantime antenna losses increase significantly because they depend on the antenna inductance which increases with the total length of the radiating element, and then overall antenna efficiency is significantly reduced.

Alternative solutions that would consist in replacing the U-shaped antenna with a multi-loop antenna, is not desirable because manufacturing process of such multi-turn antennas is more difficult.

It is then an object of the present invention, to optimise geometry of the wristband embedded antenna to obtain a good compromise between the size of the radiating surface and antenna losses.

SUMMARY OF THE INVENTION

The goal of the present invention is to provide a wrist-carried wireless instrument for receiving radio frequency signals with optimised antenna efficiency. For that purpose, the wireless instrument includes a wristband having first and second band portions connected to opposite edges of a casing, each of the first and second band portions having upper and lower surfaces. At least one single loop antenna is embedded in one band portion of the wristband and extends between the corresponding upper and lower surfaces. This loop antenna is connected via feeding lines through one edge of the casing to an antenna receiver inside the casing. The loop antenna and the feeding lines define an antenna radiating element.

In order to achieve the above mentioned goal, the antenna structure is designed with feeding lines having negligible influence as a part of the antenna radiating element, the latter being mostly defined by the loop antenna and then being substantially in a same plane parallel to the one defined by the loop antenna.

For that purpose, the feeding lines are arranged so as to be a negligible part of the antenna radiating element. According to a preferred embodiment of the present invention, the feeding lines define a first gap at connection locations with the loop antenna, with a gap's width being less than 30% of the maximum width of the loop antenna.

BRIEF DESCRIPTION OF THE DRAWINGS

The foregoing and additional objects, features and advantages of the present invention will be more readily apparent from the following detailed description of a preferred embodiment, as illustrated in the accompanying drawings, in which.

DETAILED DESCRIPTION OF A PREFERRED EMBODIMENT

As already mentioned herein before, the present invention concerns wrist-carried wireless instrument for receiving radio frequency signals, in the frequency band from 30 to 300 MHz and preferably in the frequency band from 88 to 108 MHz using the radio data transmission system. The invention more particularly relates to an antenna structure having optimised antenna efficiency, and in particular, an optimised geometry in order to obtain a good compromise between, on the one hand, the antenna radiating surface, and on the other hand, the antenna losses.

Figure 1:
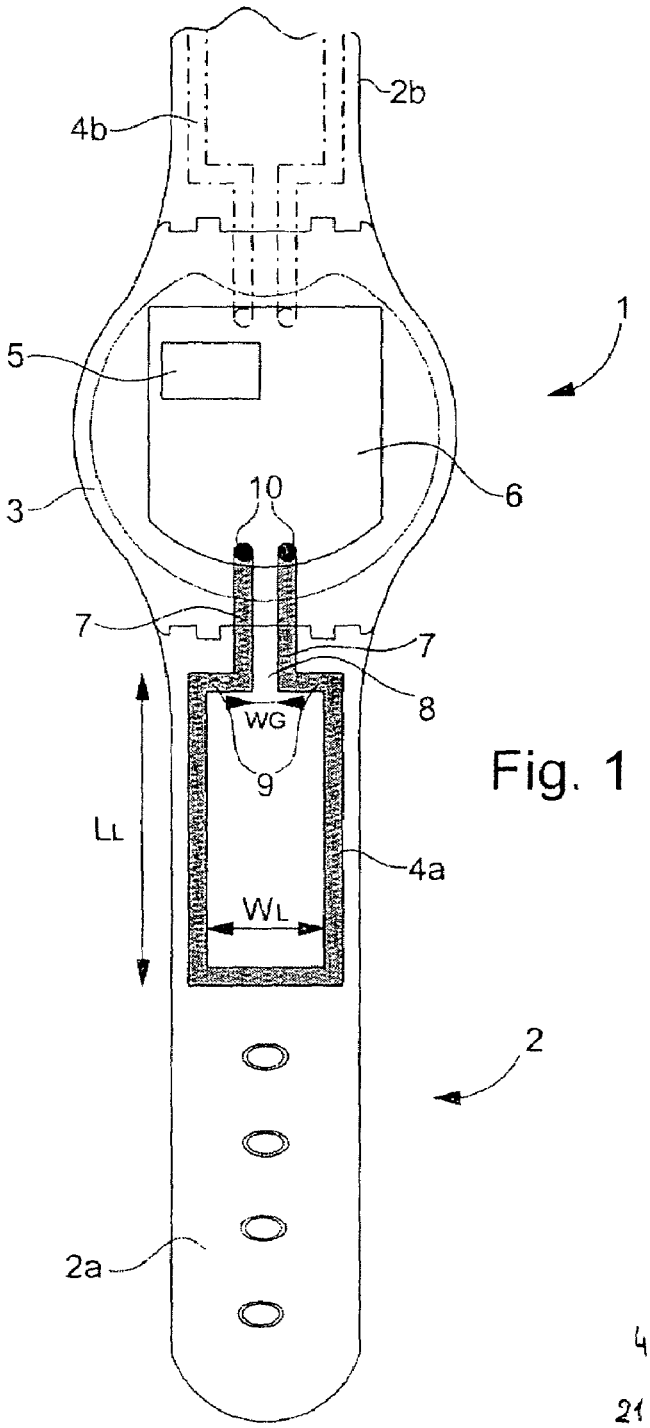
FIG. 1 is a horizontal cross-sectional view of the wrist-carried wireless instrument according to a preferred embodiment of the invention.
Figure 1A:
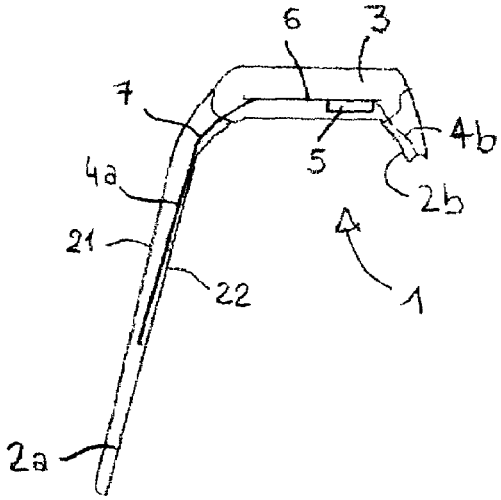
FIG. 1A is a vertical cross-sectional view of the wrist-carried wireless instrument shown in FIG. 1.

Referring first to FIG. 1, a cross-sectional view of a wrist-carried wireless instrument is shown according to a preferred embodiment of the invention. Wireless instrument 1 comprises a wristband 2 having a first 2*a* and a second 2*b* band portions connected to opposite edges of a casing 3, each band portion having upper and lower surfaces (21 and 22, see FIG. 1A). At least a first single loop antenna 4*a* is embedded in one band portions 2*a* and extends between corresponding upper 21 and lower 22 surfaces, as shown on FIG. 1A. Advantageously, the wireless instrument is provided with two single loop antennas 4*a* and 4*b*, each being embedded in one band portion 2*a* and 2*b* and extending between the corresponding upper and lower surfaces. For sake of clarity, the following description will be referring only to the "one loop antenna" embodiment, however, this should be understood as also applicable to the "two loop antennas" embodiment.

Loop antenna 4*a* is connected via feeding lines 7, through one edge of casing 3 to an antenna receiver 5 arranged on a printed circuit board 6 in said casing 3. In order to insure tightness of the casing, one possible solution is disclosed in the document EP 03020024.0 filed in the name of the same Assignee and enclosed herewith by way of reference. Additional elements, such as tuning circuits, interconnection circuits between elements on printed circuit board 6 are not directly related to the present invention and therefore are neither represented nor detailed here for sake of simplicity.

Within the frame of the present invention, it has been shown that the radiating element of the antenna structure includes not only loop antenna 4*a* but also to a certain extend feeding lines 7 connecting the loop antenna to the inside of casing 3. Therefore, the antenna radiating surface has to be considered in view of the radiating element of the antenna including both loop antenna 4*a* and feeding lines 7.

In order to reduce antenna losses without loosing a significant amount of effective radiating surface and in view of the above, the antenna structure is designed with feeding lines 7 having a negligible influence as a part of the antenna radiating element, the latter being mostly defined by the loop antenna, and then being substantially in a same first plane parallel to the one defined by the loop antenna. For that purpose, the antenna structure is provided with feeding lines 7 defining a gap 8 having a defined width $W_G$ at connection locations 9 with loop antenna 4*a*.

The ratio of the gap's width over the maximum width of the loop has to be carefully chosen in order to optimise antenna efficiency. This ratio is dependent in particular on dielectric constant of strap material, loop dimensions and performance degradation due to the tuning network and the antenna receiver.

Thus, according to a first example, the gap's width $W_G$ is less than 30% of the maximum width $W_L$ of the loop antenna. As a matter of fact, this gap decouples the feeding lines as a part of the antenna radiating element and then the feeding lines influence on antenna losses lessen. Preferably for nearly completely eliminating the influence of the feeding lines on the antenna losses, according to a second example, the gap's width is less than 10% of said first maximum width of the loop antenna. The influence of the feeding lines will be represented latter in accordance with this advantageous solution in relation with FIG. 2.

In order to further reduce influence of the feeding lines as a part of the antenna radiating element, both feeding lines 7 are parallel from connection locations 9 to connections 10 with printer circuit board 6. It is also preferable that the length of these feeding lines does not exceed 30% of the length $L_L$ of the loop antenna.

Figure 2:
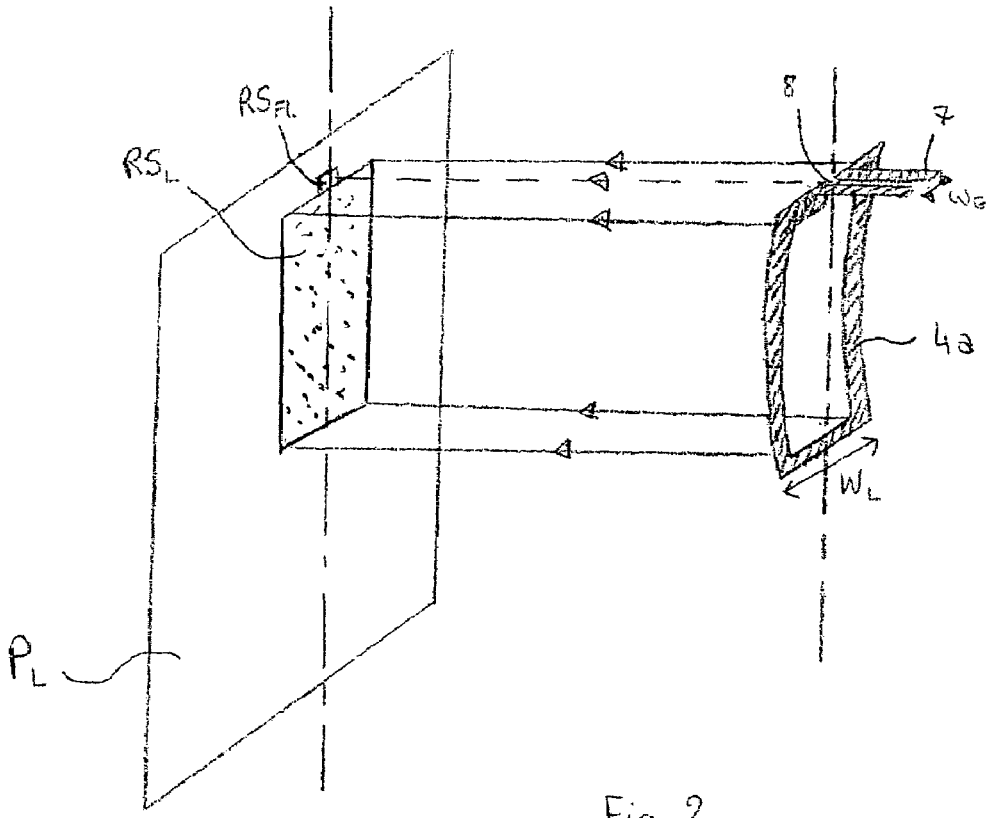
FIG. 2 is a schematic representation of the antenna radiating surface of an antenna according to the preferred embodiment shown in relation with FIGS. 1–1A.
Figure 6:
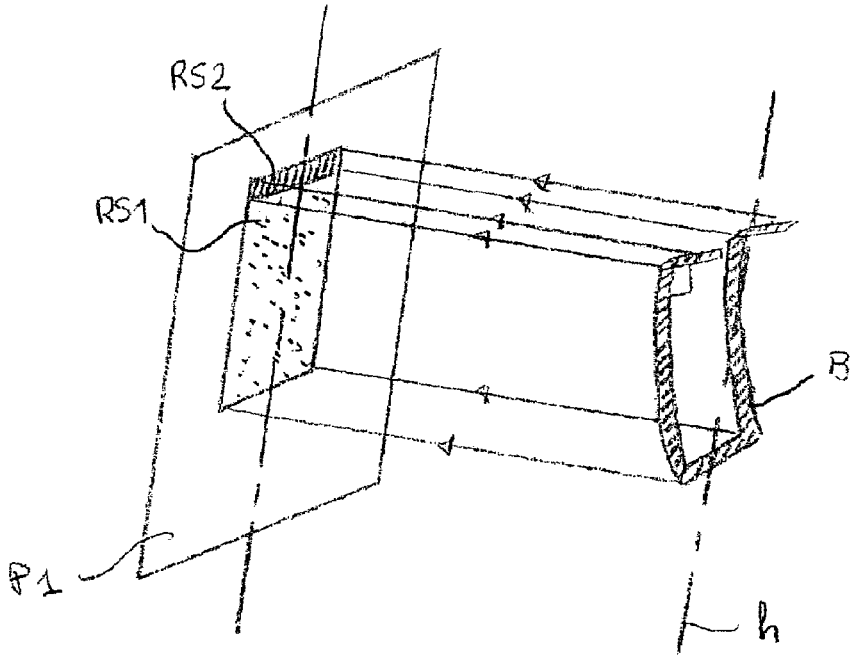
Fig. 6 (PRIOR ART)
FIG. 6, is a schematic representation of the antenna radiating surface of an antenna according to the prior art disclosed in relation with FIGS. 4 and 5.
Figure 3:
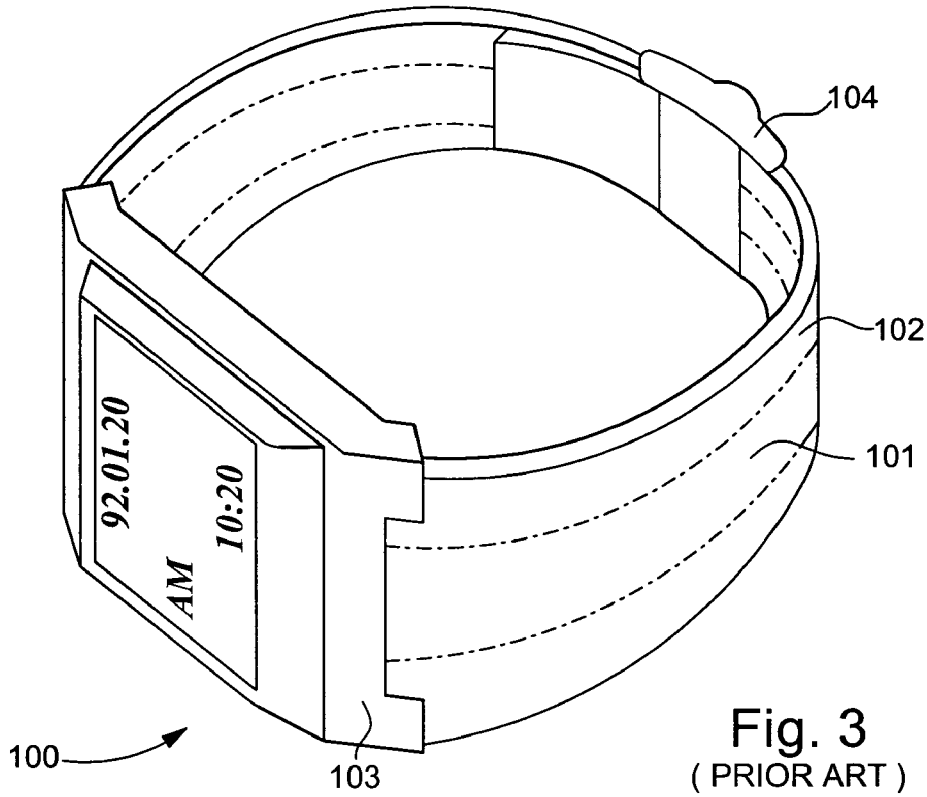
Fig. 3 ( PRIOR ART )
FIG. 3, already described, is a perspective view of a prior art wrist watch-style pager.
Figure 4:
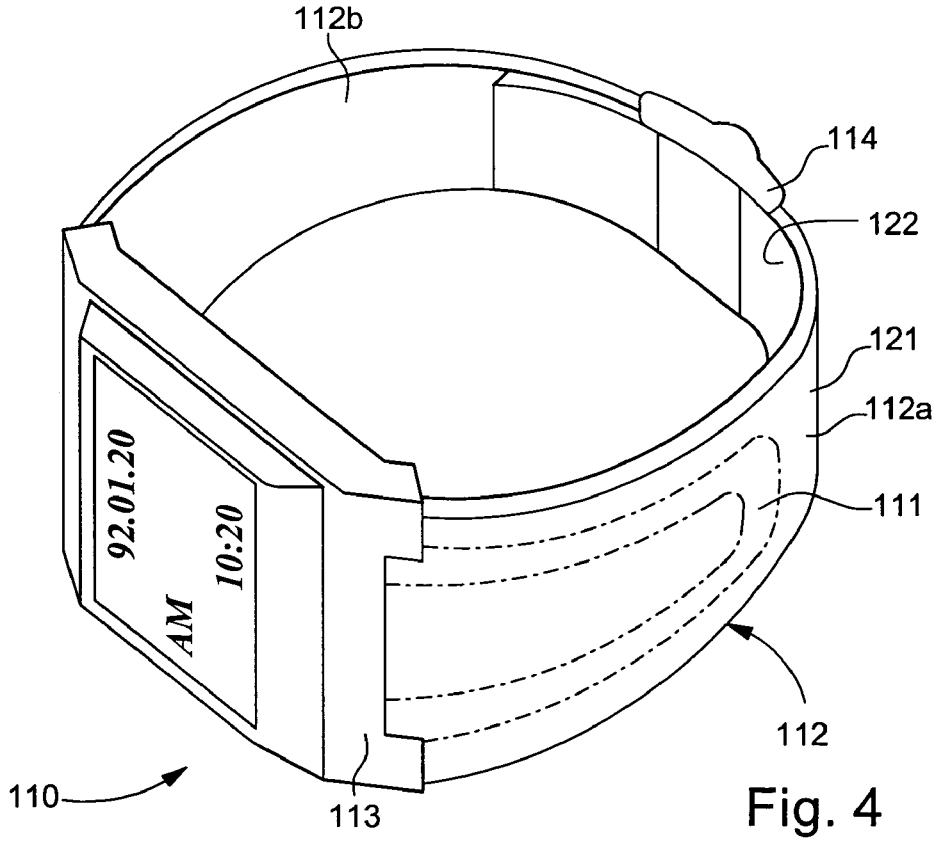
Fig. 4 ( PRIOR ART )
FIG. 4, already described, is a perspective view of another prior art wrist watch-style pager.
Figure 5:
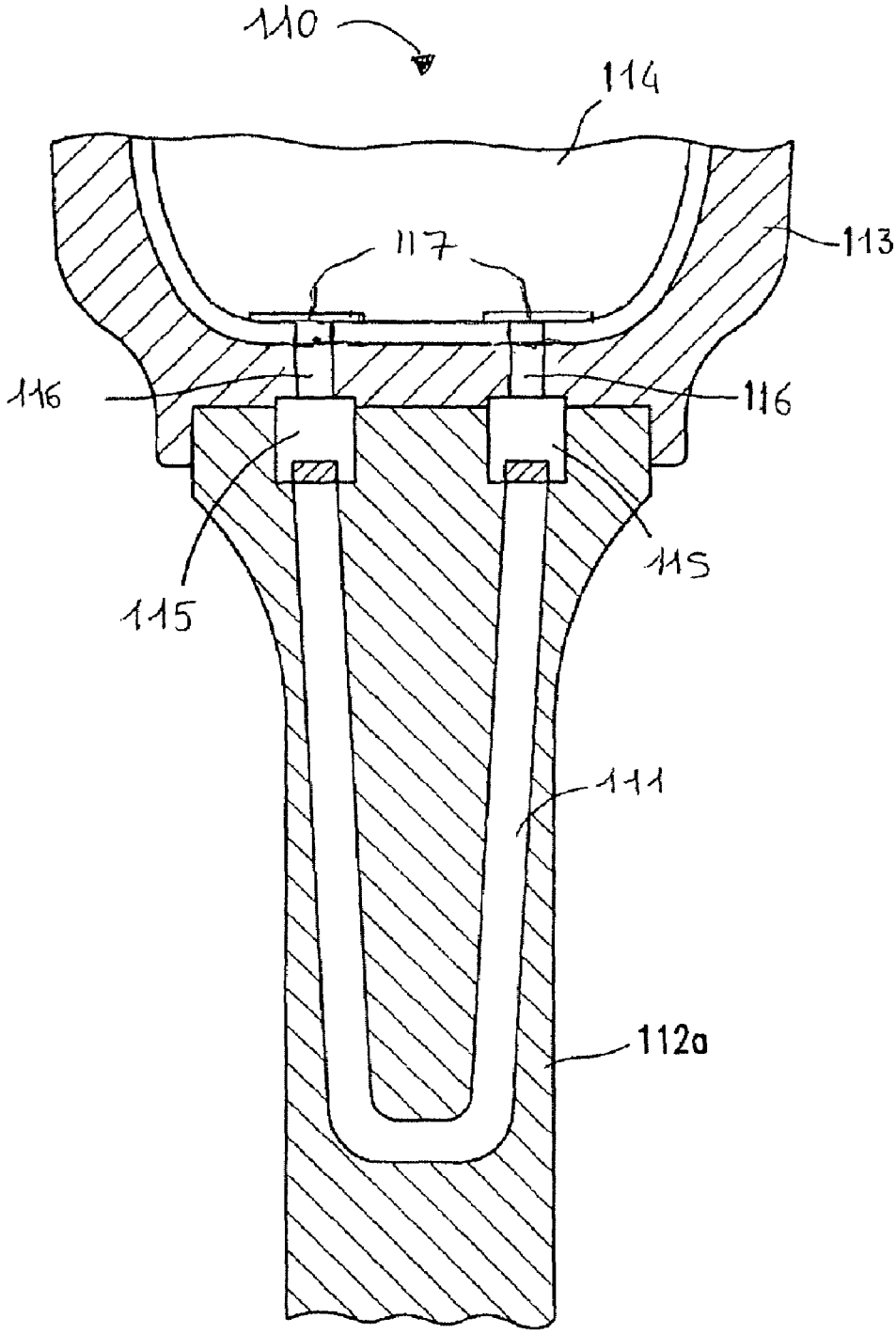
FIG. 5 (PRIOR ART)
FIG. 5, already described, is a sectional view of a portion of the wrist watch-style pager shown in FIG. 4.

FIG. 2 is a schematic representation of the resulting radiating surface when the wireless instrument is carried on the wrist as it is intended for. In this example, gap's width $W_G$ is very thin (less than 10%) compared to maximum width $W_L$ of loop antenna 4*a*. As shown, radiating surface $RS_{FL}$ projection of feeding lines 7 is negligible in comparison with radiating surface $RS_L$ projection of the loop. Thus, the resulting radiating surface can be considered as being in a same plane $P_L$ substantially parallel to the one defined by loop antenna 4*a*. Therefore, it can be deduced that feeding lines 7 do not participate as a part of the antenna radiating element, which is then mostly defined, by the loop antenna.

In conclusion, although resulting radiating surface $RS_L$ does not increase, in the meantime antenna losses do not increase as well, because they depend on the antenna inductance which remains quasi constant, the length of the radiating element being not lengthen, therefore the antenna efficiency is significantly optimised.

It is to be noted that in the alternative with two loop antennas, each one being embedded in one band portion, preferably, both loop antennas are symmetrical, and both gaps between feeding lines have substantially the same width.

It is also to be noted that each single loop antenna is preferably rectangular shaped or so-called opened O-shaped These antennas are designed to operate preferably in the frequency band from 88 to 108 MHz using the radio data transmission system.

It is further to be noted that the wireless instrument is preferably a wristwatch.

Finally, it is understood that the above described embodiments are merely illustrative of the many possible specific embodiments, which can represent principles of the present invention. Numerous and varied other arrangements can readily be devised in accordance with these principles by those skilled in the art without departing from the scope and spirit of the invention.

What is claimed is:

1. A wireless instrument including a wristband having a first and a second band portions connected to opposite edges of a casing, each of said first and second band portions having upper and lower surfaces, at least a first single loop antenna being embedded in said first band portion and extending between said corresponding upper and lower surfaces, said first single loop antenna being connected via first feeding lines through one edge of said casing to an antenna receiver inside said casing, said first single loop antenna and said first feeding lines defining a first radiating element, wherein said first feeding lines are arranged so as to be a negligible part of said antenna radiating element, wherein said first single loop antenna has a first maximum width, and wherein said first feeding lines define a first gap at connection locations with said first single loop antenna, with a first gap's width being less than 30% of said first maximum width.

2. The wireless instrument according to claim 1, wherein said first gap's width is less than 10% of said first maximum width.

3. The wireless instrument according to claim 2, in which said first loop antenna have a first determined length and wherein said feeding lines have a length which is less than 30% of said first determined length.

4. The wireless instrument according to claim 2, wherein a second single loop antenna having a second maximum width, is embedded in said second band portion, and extend between said corresponding upper and lower surfaces, said second single loop antenna being connected via second feeding lines through the opposite edge of said casing to said antenna receiver, and wherein said second feeding lines define a second gap at connection locations with said second single loop antenna, with a second gap's width being less than 10% of the second maximum width.

5. The wireless instrument according to claim 4, wherein both single loop antennas are symmetrical, both gaps have substantially the same width.

6. The wireless instrument according to claim 1, wherein a second single loop antenna having a second maximum width, is embedded in said second band portion, and extend between said corresponding upper and lower surfaces, said second single loop antenna being connected via second feeding lines through the opposite edge of said casing to said antenna receiver, and wherein said second feeding lines define a second gap at connection locations with said second single loop antenna, with a second gap's width being less than 30% of the second maximum width.

7. The wireless instrument according to claim 6, wherein both single loop antennas are symmetrical, both gaps have substantially the same width.

8. The wireless instrument according to claim 1, wherein each single loop antenna is rectangular or opened O shaped.

9. The wireless instrument according to claim 1, wherein the antenna operates in the frequency band from 88 to 108 MHz.

* * * * *